United States Patent [19]

Haas et al.

[11] Patent Number: 4,752,806

[45] Date of Patent: Jun. 21, 1988

[54] MULTI-MODE IMAGING SYSTEM

[75] Inventors: Werner E. Haas, Webster; James D. Rees, Pittsford, both of N.Y.

[73] Assignee: Xerox Corporation, Stamford, Conn.

[21] Appl. No.: 877,044

[22] Filed: Jun. 23, 1986

[51] Int. Cl.[4] ..... G03G 15/04

[52] U.S. Cl. ..... 355/3 R; 355/1; 355/8; 355/14 E

[58] Field of Search ..... 355/1, 3 R, 7, 8, 14 E, 355/67; 346/107 R, 160; 358/300; 350/331 R

[56] References Cited

U.S. PATENT DOCUMENTS

| | | | |
|---|---|---|---|
| 3,824,604 | 7/1974 | Stein | 355/1 X |
| 4,134,668 | 1/1979 | Coburn | 358/300 X |
| 4,595,259 | 6/1986 | Perregaux | 350/331 R |
| 4,714,940 | 12/1987 | Inoue et al. | 355/3 R |

FOREIGN PATENT DOCUMENTS

| | | | |
|---|---|---|---|
| 56-22451 | 3/1981 | Japan | 355/8 |
| 57-211182 | 12/1982 | Japan . | |
| 58-78173 | 5/1983 | Japan | 355/67 |
| 58-211139 | 12/1983 | Japan | 355/8 |
| 60-51360 | 3/1985 | Japan | 355/8 |
| 60-97370 | 5/1985 | Japan | 355/67 |

OTHER PUBLICATIONS

Translation of Japanese Publication No. Sho 60-97370.
Translation of Japanese Publication No. Sho 58-78173.

*Primary Examiner*—A. T. Grimley
*Assistant Examiner*—J. Pendegrass

[57] ABSTRACT

A multi-mode imaging system provides the capability of reproducing documents in a conventional COPY mode wherein a document is placed on a platen and scanned to create an exposed latent image on a photosensitive member. The system is adapted to operate in a second, print (WRITE) mode wherein an image bar, such as a light-emitting diode (LED) array or a liquid crystal shutter (LCS), is placed into optical alignment with a fixed optical system including a linear lens array. The image bar is electrically addressed to create a light output in an image-wise pattern (LCD) or to change the state of the LCS. The image output is optically coupled into the lens array which projects the image onto the photosensitive member. In one embodiment, the image bar is partially within the end portion of a movable plate.

5 Claims, 5 Drawing Sheets

50
CONTROL PANEL
54
CONTROLLER
62
SIGNAL SOURCE
60
LAMP POWER
16
12
14'
40
14
COPY
52
PLATEN DRIVE
18
20
SCAN
RETURN
22
10
31
PRINT
C
D
24
34
G
E
26
H
F

MULTI-MODE IMAGING SYSTEM

BACKGROUND AND PRIOR ART STATEMENT

The present invention relates to a multi-mode imaging system and, more particularly, to an imaging system adapted to operate in a conventional document scanning mode or, alternatively, in a print mode, wherein an optical image is selectively addressed to produce a light output conforming to an image input pattern.

The versatility of document reproduction machines is enhanced when the machine is enabled to operate in an electronic print (WRITE) mode as well as the conventional document scan/illumination (COPY) mode, using optical components such as lenses and mirrors. Examples of prior art imaging systems which operate in more than one mode are disclosed in U.S. Pat. Nos. 4,345,835, 4,477,175, 4,527,886 and 4,194,833. The '835 patent discloses a system which uses a conventional document scanning system to expose a document at a photoreceptor and, in a second mode, uses a modulated laser beam to write an image onto the photoreceptor. The '886 patent discloses a multi-mode system which incorporates a moving platen to move a document past a fixed optical system in a copy mode. A second print mode of operation is enabled by positioning a liquid crystal assembly beneath the platen and directing a light output through the same optical system to form an image conforming to the state of the liquid crystal display. The '175 patent discloses a multi-function printer which utilizes a light lens system in a COPY mode and an array of addressable LEDs beneath the platen in a WRITE mode. The '833 patent discloses, as shown in FIG. 3, a copier operating with a movable platen in a COPY mode. In FIG. 2, the copier is shown operating in a WRITE mode wherein a liquid crystal shutter (LCS) is mounted on the document platen. The state of the display is controlled by inputs from an electronic typewriter. The LCD array is addressed through a plurality of cycles which being illuminated from beneath the platen by a high intensity lamp. The reflected light exposes the drum photoreceptor in sequential fashion.

These prior art systems, and other similar systems, have the disadvantage of either requiring relatively expensive laser systems to enable the WRITE function, or locate the printing assembly components in the optical housing space, thereby increasing overall space requirements. For the system shown in the '833 patent, the optical system lacks a linear projection means which adversely affects the quality of the image transmitted to the photoreceptor surface.

It would be desirable to provide a compact document reproduction machine which, besides being operable in a conventional COPY mode, is also operable in a WRITE mode. Ideally, the WRITE mode capability should not add significantly to the manufacturing cost of the machine, or to retrofit costs, in the case of an existing machine. Further, the WRITE capability should not increase the size of the optical assembly space used in the COPY mode and should result in optimum resolution and focus of the image at the photosensitve surface. The present invention is therefore directed to a multi-mode imaging system for a document reproduction machine which, in a conventional COPY mode, provides relative scanning motion between a document on a platen and an optical system for producing an exposed image at a photoreceptor surface.

The system has a further WRITE mode capability enabled by positioning an image bar over or within the platen and in optical alignment with a linear lens array. The image bar, in a first embodiment, is a light emitting diode (LED) array partially positioned within the body of the platen or, alternatively, disposed on the top surface of the platen. In another embodiment the image bar can be an LED or a liquid crystal shutter (LCS) assembly, each respectively positioned in optical alignment with the lens upon initiation of the WRITE mode. More particularly, the invention relates to a multi-mode document imaging system having a first document COPY mode and a second document WRITE mode, said machine comprising:

- a transparent platen lying in an object plane for supporting a document in a COPY mode,
- a linear lens array disposed between the platen and a photosensitive image member,
- an optical assembly for scanning a document in the COPY mode, said assembly including an elongated illumination source for incrementally illuminating a scan strip extending across the platen width,
- a linear image bar disposed within the object plane and in optical alignment with said lens array during a WRITE mode,
- control means for providing relative movement between said platen and said optical assembly during a COPY mode so as to incrementally scan and illuminate a document placed on the surface of said platen, said control means further adapted to position and maintain said image bar in optical alignmet with said lens array upon initiation of, and during said WRITE mode, and
- an electrical signal source enabled during the WRITE mode, for providing input signals corresponding to a desired output image to said image bar whereby said image bar output is coupled into said lens array and projected onto said photosensitve member, forming a latent image thereon.

IN THE DRAWINGS

Figure 1:
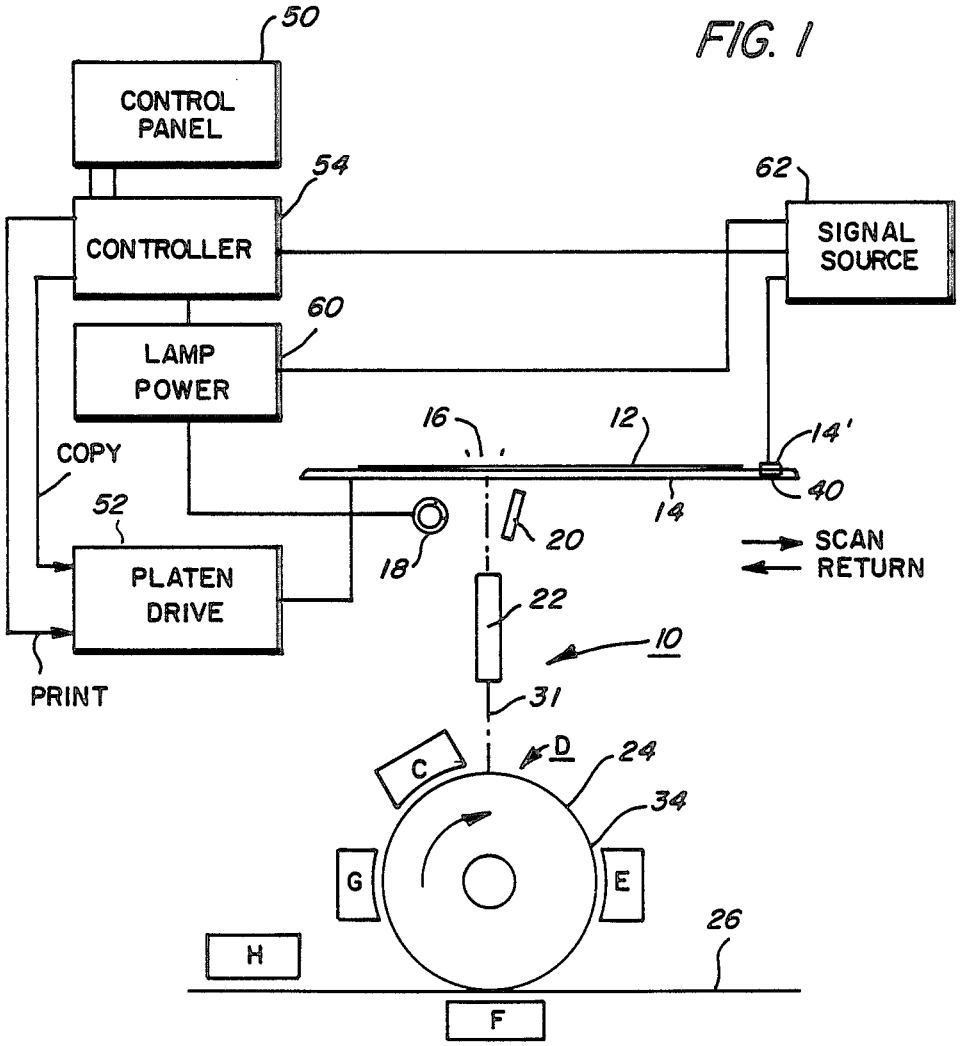
FIG. 1 is a side view of a multi-mode imaging system incorporating an image bar placed within the platen and activated during the WRITE mode.

Referring now to FIG. 1, a multi-function imaging system 10 is shown in a side view. A document 12 is placed on a platen 14 which, in a first COPY mode, moves past a narrow illumination strip 16 formed by light from an apertured linear lamp 18, acting in combination with a linear reflector 20. A linear lens array 22, which in a preferred embodiment is a gradient index lens array, is disposed in a predetermined spaced relationship between platen 14 and the surface of photoreceptor drum 24. The lens has a width dimension (into the page) corresponding generally to the width of drum 24. A suitable motor, (not shown) rotates drum 24 in the indicated direction. Arranged around drum 24 are conventional xerographic stations. The drum surface receives an electrostatic charge at Station C. In a preferred embodiment, the photoreceptor has properties disclosed in U. S. Pat. No. 4,265,990 and station C applies a negative charge. Other types of photoreceptors which operate under positive charging requirements can also be used. The drum movement continues through the exposure zone D where a latent image of the document is formed. The latent image is developed at development station E by application of toner material of appropriate polarity (positive for this embodiment). The developed image is brought into contact with support sheet 26 within a transfer station F and the toner image is electrostatically attracted from the drum surface to the contacting side of the support sheet. Any residual toner particles remaining on the drum surface after the completion of the transfer operation are removed within a cleaning station G, placing the surface in a condition to repeat the process. After the transfer operation, the image-bearing support sheet is forwarded to a fusing station H via a suitable conveyor. These xerographic processing steps are well-known in the art as exemplified by U.S. Pat. No. 4,397,409 whose contents are hereby incorporated by reference.

Figure 2:
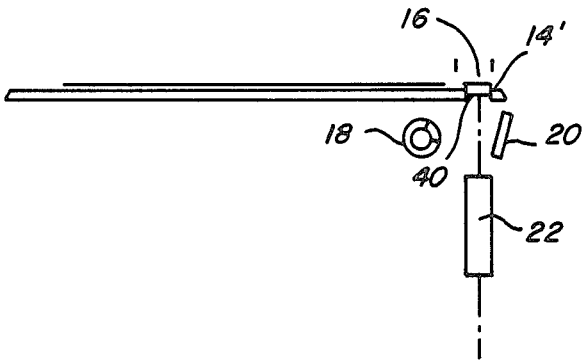
FIG. 2 shows the imaging system of FIG. 1 with the platen moved to the WRITE position.
Figure 3:
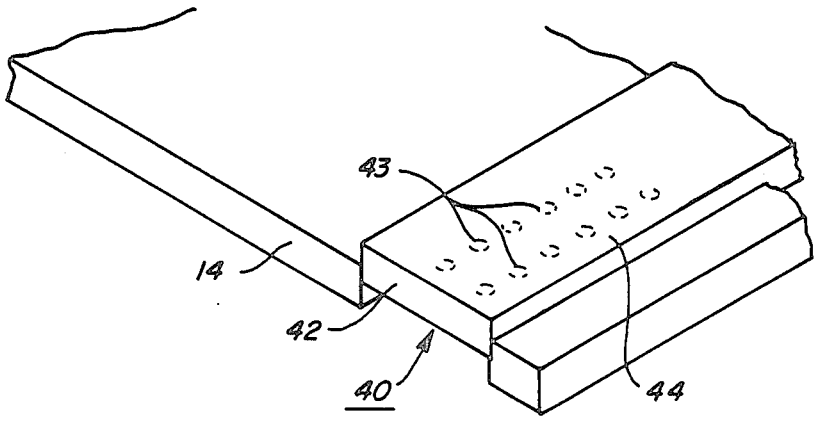
FIG. 3 is a partial top perspective view of the end portion of the document platen of FIG. 1 showing the positioning of the image bar.

According to a first aspect of the invention, platen 14 has an end portion 14' shown in FIGS. 2 and 3. Partially contained within the body of platen end section 14', and aligned in the same effective object plane as the document, is an image bar 40. Bar 40, as shown in FIG. 3, comprises an elongated, generally rectangular, base or substrate 42, having an array of individual elements such as light emitting diodes (LEDs) 43 arranged in at least one linear row. Preferably, the width of substrate 42 in a cross-scan direction is such that the length of the row(s) 44 of LEDs is substantially equal to the effective width of the photoreceptor. For a platen of thickness t, the LED rows should be arranged appropriately a distance of $\frac{1}{3}$ t beneath the top surface of the platen.

A first, conventional COPY mode, is enabled by selection of an appropriate switch at the operator control panel 50, FIG. 1. Platen drive circuit 52, under control of controller 54, moves platen 14 in the indicated direction to incrementally move the platen (and document) through scan strip 16. Power is supplied to lamp 18 by lamp power supply 60, providing illumination at scan strip 16. The illumination efficiency is increased by using reflector 20 on the opposite side of the scan strip. As document 12 moves past strip 16, an incremental line image is reflected downward and projected by lens array 22 onto the surface of photoreceptor drum 24. At the completion of the platen scan excursion, the entire document has been exposed at the drum surface. The latent image is then developed and transferred as described above. Platen 14, under the continued control of controller 54 is returned to a start of scan position.

The WRITE mode is enabled by selecting a write switch at control panel 50 or, alternately, by activation from a remote device via an electrical signal. Controller 54 receives the WRITE signal and generates an output sent to platen drive 52 causing drive 52 to move platen 14 from right to left to the position shown in FIG. 2. Platen section 14' is thus positioned such that image bar 40 is placed in optical alignment with lens array 22. A second signal is sent from controller 54 to lamp power supply 60, removing power from lamp 18. A third signal is sent to enable signal source 62. Image signals from source 62 are applied in succession to individual LEDs on image bar 40. The LEDs function as individually-controlled light emitters, producing incremental light outputs which enter the optically aligned gradient index fibers comprising lens array 22. The light output is then projected onto the drum surface selectively exposing the surface line by line in accordance with the digitized input signal from source 62.

If the same development system is to be used for both the COPY and WRITE mode, a xerographic development system capable of accommodating both image polarities e.g. write white and write black, will be used. Toner and biasing voltage bias parameters are selected as appropriate and as known to those skilled in the art.

Figure 4:
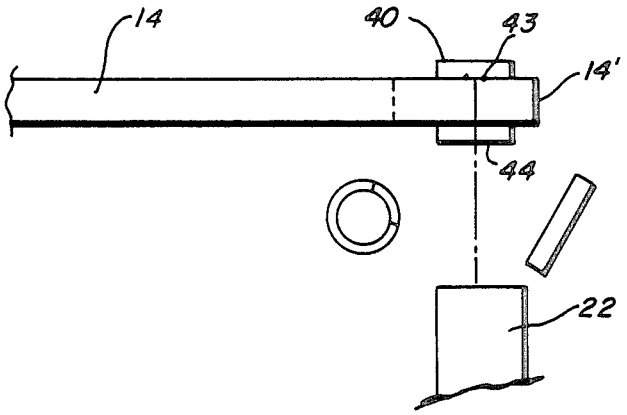
FIG. 4 shows a variation of the FIG. 1 system where the image bar is disposed on the top surface of the platen.

An alternate arrangement for the LED image bar is on the top surface of the platen with the LED rows adjacent the top surface of the platen. For this embodiment, shown in side view in FIG. 4, an elongated glass strip 44 is added beneath the platen to compensate for the conjugate change created by moving the array completely above the platen.

Figure 5:
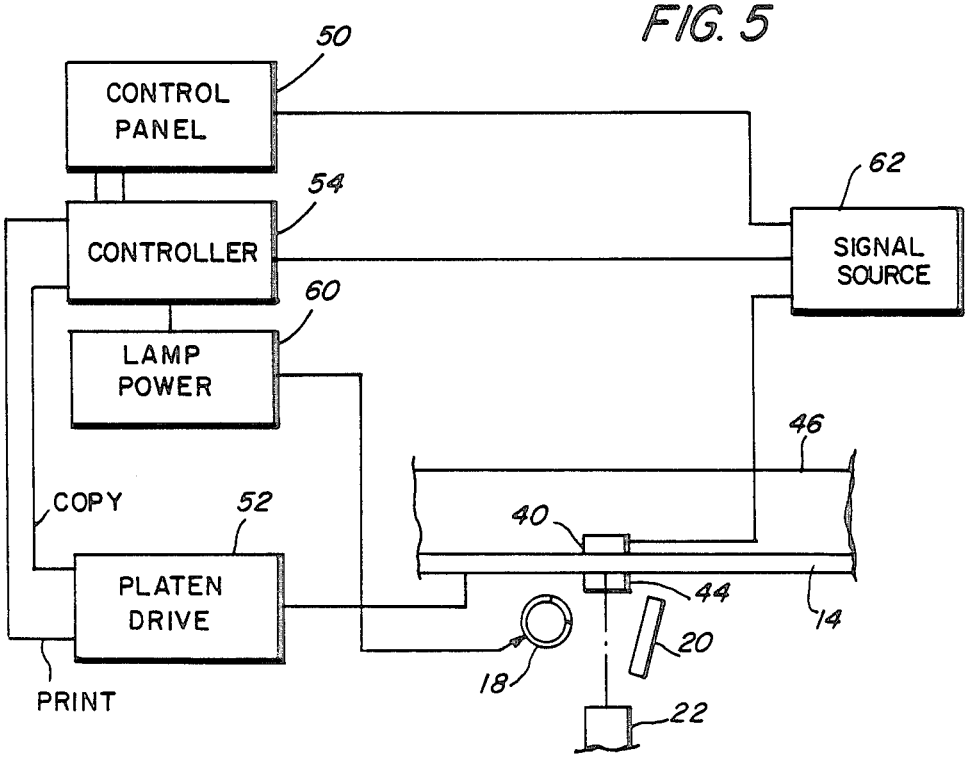
FIG. 5 shows the imaging system of FIG. 4 with the image bar stored in the platen cover.

For some systems, an extension of the platen to accommodate the image bar may not be practicable. The present invention may also be practised by disposing an image bar in a predetermined position over the platen during a WRITE mode. FIG. 5 is a side view of a portion of the scan system showing the image bar 40 disposed within a platen cover 64. Glass member 44 is placed beneath plate 14 in alignment with image bar 4. During a COPY mode, the image bar remains in a non-energized state. Upon a WRITE mode enablement, a signal from controller 54 to platen drive 52 causes the platen to move to the position shown where image bar 40 is in optical alignment with the optical fibers of lens array 22 through the transparent body of platen 14 and glass member 44. The WRITE mode then proceeds in the manner described above in connection with the FIG. 2 embodiment; e.g. the illumination system is turned off and light bar 40 produces a light output to selectively expose the photoreceptor in accordance with the digitized input signal. Upon return to the COPY mode, the platen is returned to the start-of-scan position and power is restored to the illumination lamp.

For all of the above configurations, a preferred embodiment contains LEDs with a density of 300 spots per inch (spi) and arranged in one or more rows. Lens array 22 is a commercially available SLA9 SELFOC lens array made of Nippon Sheet Glass Co.. SELFOC is trademark owned by Nippon Sheet Glass Co..

Figure 6:
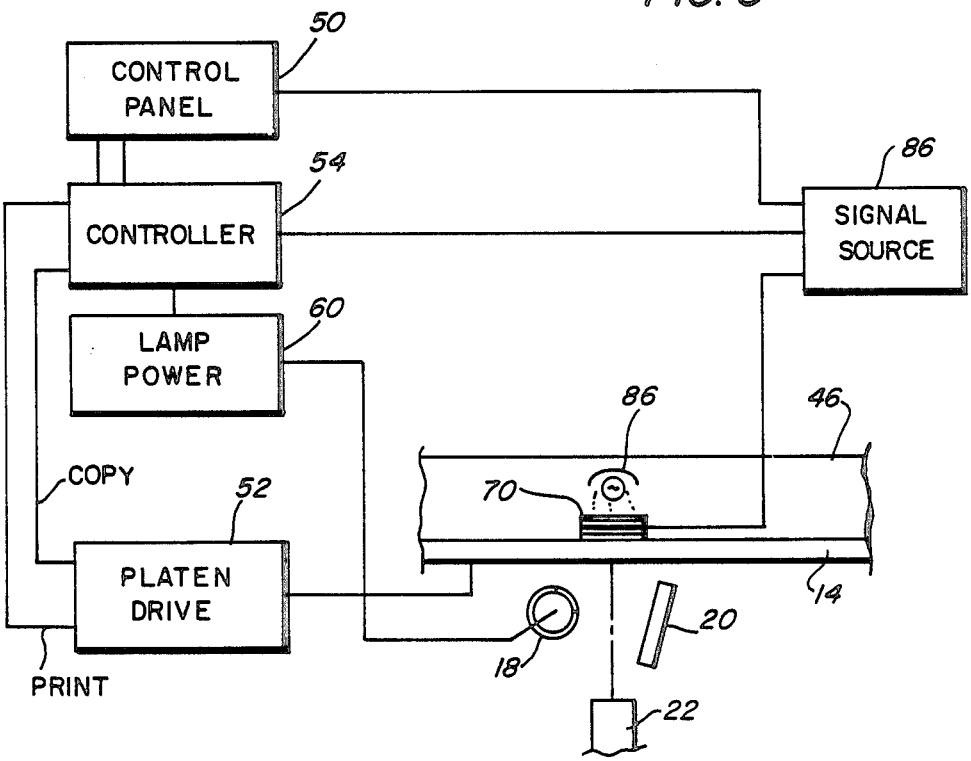
FIG. 6 is a second embodiment of the system of FIG. 1 showing a liquid crystal shutter (LCS) assembly disposed on the top surface of the platen.
Figure 7:
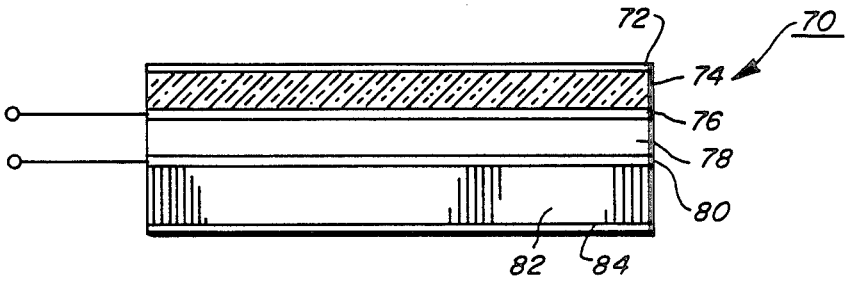
FIG. 7 is an enlarged, cross-sectional view of the LCS assembly of FIG. 6.

Other types of image bars are suitable for use in the WRITE mode, liquid crystal shutters (LCS) being one favored example. LCSs can be characterized as light-controlling devices as contrasted to the LEDs which are light-emitting devices. The LCS can be used as an image bar in any of the configurations shown in FIGS. 2, 4 and 5 with appropriate modification to the illumination assembly and to the light-coupling mechanism. FIG. 6 shows the FIG. 5 embodiment with LED image bar 40 replaced by an LCS assembly 70. The LCS cells, for this embodiment, are of the smectic, cholesteric or nematic type which may require polarizing components. As shown in enlarged detail in FIG. 7, image bar 70 comprises a first polarizing layer 72 having a glass layer 74, a transparent conductive film 76, LCS 78 array, a second transparent conductive film 80, fiber optic faceplate 82 and a second polarizing layer 84. An electric field is connected across conductive films (electrodes) 76, 80. Linear lamp assembly 86 output is adjusted by lamp power circuit 60 and controller 54 to produce the desired illumination which is directed through the portions of the LCS 78 rendered transmissive or opaque by application of the electric field. For some systems, the illumination may be provided from beneath the platen by appropriate positioning of the illumination lamp and the addition of a reflective film on the top surface of image bar 70. Fiber optic faceplate 82 comprises a plurality of optical fibers, each fiber in alignment with an LCS cell. The faceplate serves to guide the light from the LCS to the input face of the individual fibers comprising lens array 22. The LCS array may also be used in an open platen mode. For this cas, the LCS assembly and lamp 86 may be positioned, either mechanically or manually, on the platen at the scan position. As a still further alternative, selection of a cholesteric type liquid crystal cell removes the requirement for using polarizing layers 72 and 84.

Figure 8:
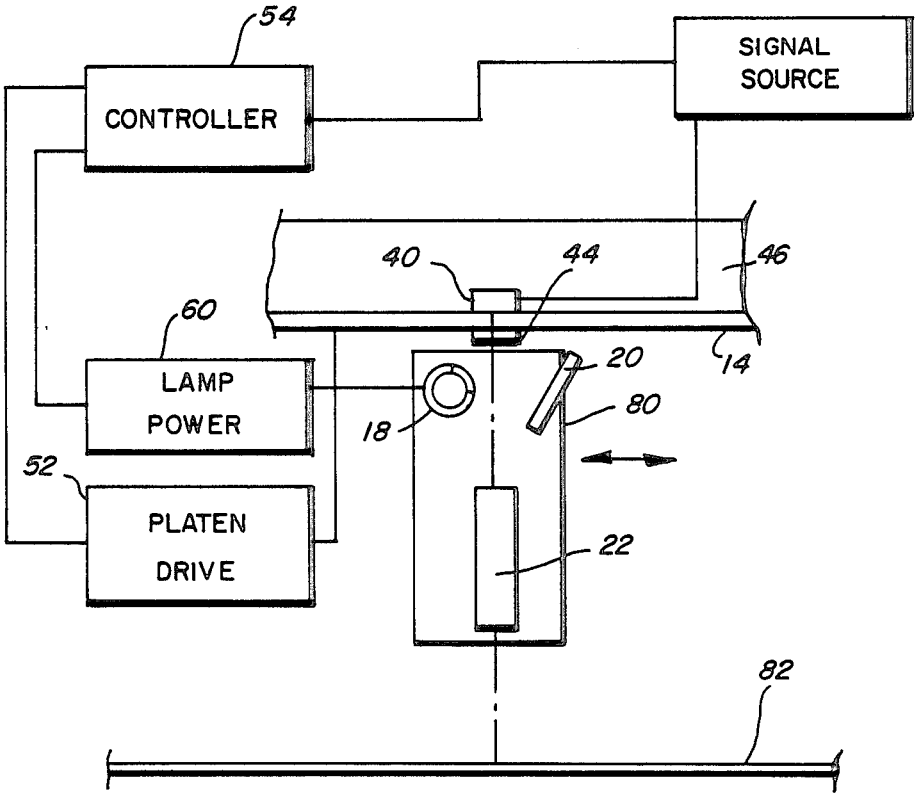
FIG. 8 is a variation of the FIG. 4 imaging system wherein the platen is fixed and the optical assembly scans the document in the COPY mode.

FIG. 8 shows a variation of the FIG. 5 system wherein the platen 14 is fixed and the optics is adapted to scan beneath the platen. For this example, lamp 18, reflector 20 and lens array 22 are mounted on a carriage 80, adapted to move in a parallel path beneath the surface of the platen. Carriage 80 is moved from left to right to scan the document on the platen to incrementally propagate an image onto the surface of a photoreceptor belt 72 moving in the indicated direction. Upon initiation of a WRITE mode, image bar 40 is moved into the PRI position overlying the platen and carriage 80 is moved to a position where image bar 40 is in optical alignment with the array. The WRITE operation then proceeds as described above. The moving optic configuration can also be used in conjunction with the LCS embodiment.

Although the present invention has been described with particularity relative to the foregoing detailed description of the exemplary preferred embodiments, various modifications, changes, additions and applications of the present invention, in addition to those mentioned herein, will be readily apparent to those having normal skill in the art without departing from the spirit of this invention. As one example, although the linear lens arrays disclosed herein are of the gradient index type, other suitable linear lens arrays may be used; e.g. a strip lens array of the type disclosed in U.S. Pat. No. 3,584,952. Finally, although a platen was used to transport a document past a scan strip area, it is understood that the document itself could be moved across the surface of a stationary plate as is known in the art. All of these various changes and embodiments are intended to be embraced by the following claims:

What is claimed is:

1. A multi-mode document imaging system having a first document COPY mode and a second document WRITE mode, said machine comprising:

a transparent platen lying in an object plane for supporting a document in a COPY mode, a linear lens array disposed between the platen and a photosensitive image plane, an optical assembly for scanning a document in the COPY mode, said assembly including an elongated illumination source for incrementally illuminating a scan strip extending across the platen width, a linear image bar including a plurality of light-emitting elements contained within the body of the platen and in optical alignment with said lens array during a WRITE mode, control means for providing relative movement between said platen and said optical assembly during a COPY mode so as to incrementally scan and illuminate a document placed on the surface of said platen, said control means further adapted to position and maintain said image bar in optical alignment with said lens array upon initiation of, and during said WRITE mode, and an electrical signal source enabled during the WRITE mode, for providing input signals corresponding to a desired output image to said image bar whereby said image bar output is directed into said lens array and projected onto said photosensitive plane, forming a latent image thereon.

2. The imaging system of claim 1 wherein said platen is fixed and said linear lens assembly and optical assembly are movable.

3. A multi-mode document imaging system having a first document COPY mode and a second document WRITE mode, said machine comprising:

a transparent platen lying in an object plane for supporting a document in a COPY mode, a linear lens array disposed between the platen and a photosensitive image plane, an optical assembly for scanning a document in the COPY mode, said assembly including an elongated illumination source for incrementally illuminating a scan strip extending across the platen width, a linear image bar including a plurality of light-controlling elements contained within the body of the platen and in optical alignment with said lens array during a WRITE mode, control means for providing relative movement between said platen and said optical assembly during a COPY mode so as to incrementally scan and illuminate a document placed on the surface of said platen, said control means further adapted to position and maintain said image bar in optical alignment with said lens array upon initiation of, and during said WRITE mode, and an electrical signal source enabled during the WRITE mode, for providing input signals corresponding to a desired output image to said image bar whereby said image bar output is coupled into said lens array and projected onto said photosensitve plane, forming a latent image thereon.

4. A multi-mode document imaging system having a first document COPY mode and a second document WRITE mode, said machine comprising:

a transparent platen lying in an object plane for supporting a document in a COPY mode, a linear lens array disposed between the platen and a photosensitive image plane, an optical assemlby for scanning a document in the COPY mode, said assembly including an elongated illumination source for incrementally illuminating a scan strip extending across the platen width, a liquid crystal shutter assembly positioned adjacent the platen surface and in optical alignment with said lens array during a WRITE mode, said display assembly optically coupled to the platen by a fiber-optic faceplate, control means for providing a relative movement between said platen and said optical assembly during a COPY mode so as to incrementally scan and illuminate a document placed on the surface of said platen, said control means further adapted to position and maintain said display assembly in optical alignment with said lens array upon initiation of, and during said WRITE mode, and an electrical signal source enabled during the WRITE mode, for providing input signals corresponding to a desired output image to said display assembly whereby said display assembly output is coupled into said lens array and projected onto said photosensitive plane, forming a latent image thereon.

5. The imaging system of claim 4 further including an auxiliary light source disposed above the LCS assembly and adapted to be energized during the WRITE mode.

* * * * *